US010002569B2

(12) United States Patent
Park et al.

(10) Patent No.: US 10,002,569 B2
(45) Date of Patent: Jun. 19, 2018

(54) ORGANIC LIGHT EMITTING DISPLAY DEVICE

(71) Applicant: LG DISPLAY CO., LTD., Seoul (KR)

(72) Inventors: Kwang-Mo Park, Uijeongbu-si (KR); Yoon-Ju Lee, Gangneung-si (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days. days.

(21) Appl. No.: 14/858,758

(22) Filed: Sep. 18, 2015

(65) Prior Publication Data

US 2016/0086544 A1 Mar. 24, 2016

(30) Foreign Application Priority Data

Sep. 19, 2014 (KR) ..... 10-2014-0124850

(51) Int. Cl.
*G09G 3/3266* (2016.01)
*G09G 3/3291* (2016.01)
*G09G 3/3233* (2016.01)

(52) U.S. Cl.
CPC ..... *G09G 3/3266* (2013.01); *G09G 3/3233* (2013.01); *G09G 3/3291* (2013.01); *G09G 2300/0842* (2013.01); *G09G 2320/0233* (2013.01); *G09G 2320/0295* (2013.01); *G09G 2320/043* (2013.01)

(58) Field of Classification Search
None
See application file for complete search history.

(56) References Cited

U.S. PATENT DOCUMENTS

2008/0231560 A1* 9/2008 Yamashita ..... G09G 3/3233 345/76
2008/0231562 A1* 9/2008 Kwon ..... G09G 3/3233 345/77
2008/0297449 A1* 12/2008 Yamashita ..... G09G 3/3233 345/76
2009/0322734 A1* 12/2009 Yamamoto ..... G09G 3/3233 345/214
2010/0073346 A1* 3/2010 Min ..... G09G 3/3291 345/211

(Continued)

FOREIGN PATENT DOCUMENTS

CN 103165078 A 4/2013
CN 103165078 A 6/2013
KR 10-2013-0036661 A 4/2013

*Primary Examiner* — Jennifer Mehmood
*Assistant Examiner* — Parul Gupta
(74) *Attorney, Agent, or Firm* — Birch, Stewart, Kolasch & Birch, LLP

(57) ABSTRACT

Discussed is an organic light emitting display device capable of sensing and compensating characteristics of light emitting elements thereof. The organic light emitting display device according to an embodiment includes a light emitting display panel including a plurality of pixels, each pixel having a light emitting element and a pixel driving circuit to drive the light emitting element; and a panel driving unit for supplying compensated data voltages to the plurality of pixels, respectively, sensing at least one characteristic of a driving point of the light emitting element in each of the pixels and a threshold voltage of the light emitting element during at least one of light emission and non-emission periods of the light emitting element, and generating compensated data for the light emitting element, using the sensed characteristic.

10 Claims, 13 Drawing Sheets

(56) References Cited

U.S. PATENT DOCUMENTS

| | | | | |
|---|---|---|---|---|
| 2010/0156881 | A1* | 6/2010 | Kohno | G09G 3/3233 345/213 |
| 2011/0164025 | A1* | 7/2011 | Saito | G09G 3/3233 345/212 |
| 2013/0050292 | A1* | 2/2013 | Mizukoshi | G09G 3/3291 345/690 |
| 2017/0169767 | A1* | 6/2017 | Song | G09G 3/3291 |

* cited by examiner

ORGANIC LIGHT EMITTING DISPLAY DEVICE

This application claims the priority benefit of Korean Patent Application No. 10-2014-0124850, filed on Sep. 19, 2014, which is hereby incorporated by reference as if fully set forth herein.

BACKGROUND OF THE INVENTION

Field of the Invention

The present invention relates to an organic light emitting display device, and more particularly to an organic light emitting display device capable of sensing and compensating characteristics of light emitting elements thereof.

Discussion of the Related Art

Image display devices, which render a variety of information on a screen, are core technologies of the information communication age, and are being developed toward improved thinness, lightness, portability, and performance improved. As a result, an organic light emitting display device or the like, which displays an image through an amount of light emitted from an organic light emitting layer, is highlighted as a flat display device capable of eliminating drawbacks of a cathode ray tube (CRT), that is, achieving a reduction in weight and a reduction in volume.

Such an organic light emitting display device includes a plurality of pixels arranged in matrix form, to display an image. In this case, each pixel includes a light emitting element, and a pixel driving circuit including a plurality of transistors to drive the light emitting element in an independent manner.

In organic light emitting display devices according to a related art, however, light emitting elements thereof are degraded with passage of time. That is, as shown in FIG. 1, current-voltage (I-V) characteristics of a light emitting element are degraded with passage of time. As a result, the point of intersection between a characteristic curve of a driving transistor and a characteristic curve of the light emitting element, namely, a driving point, shifts (DP→DP'). This causes generation of a latent image or non-uniformity of luminance. Reduced luminance may cause a reduction in lifespan of the product.

Therefore, an organic light emitting display device capable of sensing and compensating characteristics of light emitting elements thereof is needed.

SUMMARY OF THE INVENTION

Accordingly, the present invention is directed to an organic light emitting display device that substantially obviates one or more problems due to limitations and disadvantages of the related art.

An object of the present invention is to provide an organic light emitting display device capable of sensing and compensating characteristics of light emitting elements thereof.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, an organic light emitting display device includes a light emitting display panel including a plurality of pixels each comprising a light emitting element and a pixel driving circuit to drive the light emitting element, and a panel driving unit for supplying compensated data voltages to the plurality of pixels, respectively, sensing at least one characteristic of a driving point of the light emitting element in each of the pixels and a threshold voltage of the light emitting element during at least one of light emission and non-emission periods of the light emitting element, and generating compensated data for the light emitting element, using the sensed characteristic.

In accordance with the organic light emitting device of the present invention, it may be possible to sense a driving point of the light emitting element and a threshold voltage of the light emitting element through sensing of an anode voltage of the light emitting element. Accordingly, it may be possible to generate compensated data according to driving point shift and threshold voltage variation of the light emitting element and, as such, an increase in lifespan and an enhancement in luminance may be achieved.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and along with the description serve to explain the principle of the invention. In the drawings.

DETAILED DESCRIPTION OF THE INVENTION

Reference will now be made in detail to the preferred embodiments of the present invention, examples of which are illustrated in the accompanying drawings.

Figure 1:
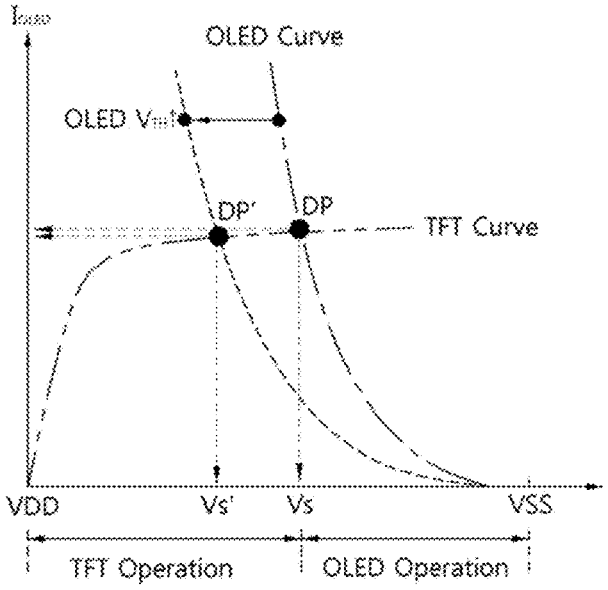
FIG.1 Related Art
FIG. 1 is a diagram illustrating characteristic curves of a driving transistor and a light emitting element in an organic light emitting display according to a related art.
Figure 2:
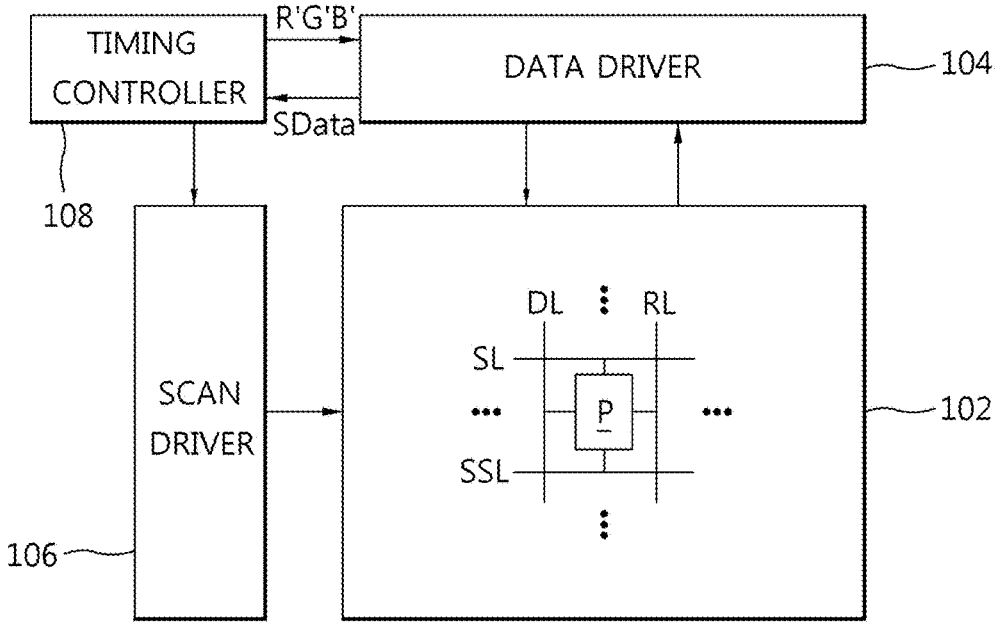
FIG. 2 is a block diagram illustrating an organic light emitting display device according to an embodiment of the present invention.

FIG. 2 is a block diagram illustrating an organic light emitting display device according to the present invention. The organic light emitting display device according to all the embodiments of the present invention are operatively coupled and configured.

The organic light emitting display device illustrated in FIG. 2 includes a panel driving unit including a data driver 104, a scan driver 106 and a timing controller 108, and a light emitting display panel 102.

The timing controller 108 generates a plurality of control signals to control respective drive timings of the scan driver 106 and data driver 104. The control signals generated by the timing controller 108 include a scan control signal to control driving timing of the scan driver 106, and a data control signal to control driving timing of the data driver 104.

The timing controller 108 also stores sensing data SData input from the data driver 104 and compensation values determined based on the sensing data SData in a memory including a plurality of lookup tables. Using the compensation values, the timing controller 108 varies data input from the outside, to generate compensated digital data R'G'B', and then supplies the compensated digital data R'G'B' to the data driver 104.

Figure 3:
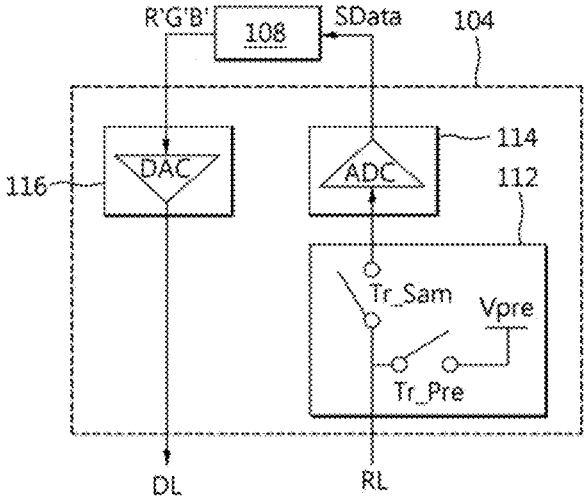
FIG. 3 is a block diagram explaining a data driver illustrated in FIG. 2 in detail.

The data driver 104 generates sensing data SData, and supplies the generated sensing data SData to the timing controller 108. The data driver 104 also converts the compensated digital data R'G'B' into an analog data voltage, using a control signal and a gamma voltage from the timing controller 108, and supplies the analog data voltage to data lines DL. To this end, as illustrated in FIG. 3, the data driver 104 includes a switching unit 112, a sensing unit 114, and a data output unit 116.

The switching unit 112 includes a sampling transistor Tr_Sam and a precharging transistor Tr_Pre.

The precharging transistor Tr_Pre turns on in response to a precharging control signal supplied from the timing controller 108 for an initialization period. Accordingly, a precharging voltage Vpre is supplied to a reference line RL via the precharging transistor Tr_Pre and, as such, the reference line RL is initialized with the precharging voltage Vpre.

The sampling transistor Tr_Sam turns on in response to a sampling control signal supplied from the timing controller 108 for a sensing period and, as such, connects the reference line RL to an analog-to-digital converter ADC of the sensing unit 114.

The sensing unit 114 is connected to the reference line RL via the sampling transistor Tr_Sam and, as such, senses a voltage of the reference line RL. Based on the sensed voltage, the analog-to-digital converter ADC of the sensing unit 114 generates sensing data SData, which is a digital signal, and then supplies the sensing data SData to the timing controller 108.

The data output unit 116 includes a plurality of digital-to-analog converters DAC. In response to a data control signal supplied from the timing controller 108, the data output unit 116 converts compensated digital data R'G'B' input from the timing controller 108 into an analog data voltage, and supplies the converted analog data voltage to the data lines DL.

In response to a scan control signal from the timing controller 108, the scan driver 106 supplies a first scan voltage having a high level or a low level to scan lines SL formed at the light emitting display panels 102 while supplying a second scan voltage having a high level or a low level to sensing control lines SSL.

The light emitting display panel 102 includes a plurality of pixels P arranged in matrix form.

Figure 4:
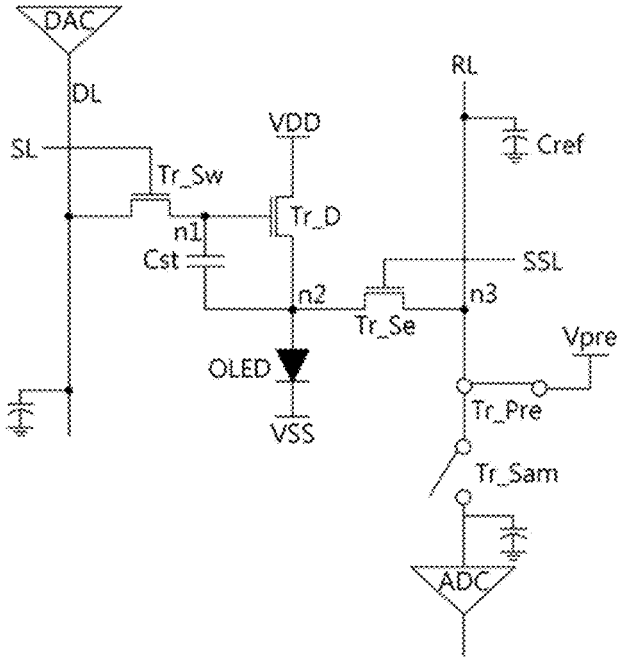
FIG. 4 is a block diagram explaining a pixel driving circuit of the organic light emitting display device illustrated in FIG. 2.

As illustrated in FIG. 4, each pixel P includes a light emitting element OLED, and a pixel driving circuit including a plurality of transistors to drive the light emitting element OLED. The pixel driving circuit includes a driving transistor Tr_D, a switching transistor Tr_Sw, a sensing transistor Tr_Se, and a storage capacitor Cst.

The switching transistor Tr_Sw includes a gate connected to the scan line SL corresponding to the pixel P, a source connected to the data line DL corresponding to the pixel P, and a drain connected to a first terminal of the storage capacitor Cst, namely, a first node n1. Accordingly, the switching transistor Tr_Sw supplies a data voltage Vdata from the data line DL to the first node n1 for the initialization period in response to the first scan signal from the scan line SL corresponding to the pixel P.

The sensing transistor Tr_Se includes a gate connected to the sensing control line SSL corresponding to the pixel P, a source connected to a second node n2, and a drain connected to a third node n3. Accordingly, the sensing transistor Tr_Se supplies the precharging voltage from the reference line RL for the initialization period in response to the second scan signal from the sensing control line SSL, and supplies a voltage on an anode of the corresponding light emitting element OLED to the reference line RL for the sensing period.

The driving transistor Tr_D includes a gate connected to the first node n1, a drain connected to a high-level drive voltage source VDD, and a source connected to the anode of the corresponding light emitting element OLED. Accordingly, the driving transistor Tr_D adjusts an amount of current flowing through the light emitting element OLED in accordance with a source-gate voltage thereof, namely, a voltage applied between the high-level voltage source VDD and the first node n1.

The storage capacitor Cst is connected, at the first terminal thereof, to the first node n1 while being connected, at a second terminal thereof, to the second node n2. The storage capacitor Cst charges a voltage difference between voltages respectively supplied to the first and second nodes n1 and n2, and supplies the charged voltage difference as a drive voltage Vgs of the driving transistor Tr_D. For example, the storage capacitor Cst charges a voltage difference between a data voltage Vdata and a precharging voltage Vpre respectively supplied to the first and second nodes n1 and n2.

A reference capacitor Cref is connected, at a first terminal thereof, to the third node n3 while being connected, at a second terminal thereof, to a ground voltage source and, as such, is connected in parallel to the reference line RL. The reference capacitor Cref charges a voltage of the anode of the light emitting element OLED through the sensing transistor Tr_Se turning on for the sensing period. The capacitance of the reference capacitor Cref is higher than the capacitance of a light emitting capacitor Coled, namely, the light emitting element OLED.

The light emitting element OLED emits light in accordance with a drive current supplied through the driving transistor Tr_D. To this end, the light emitting element OLED includes the anode, which is connected to the second node n2, namely, the source of the driving transistor Tr_D, a cathode connected to a low-level voltage source VSS to supply a lower voltage than that of the high-level voltage source VDD, and an organic light emitting layer formed between the anode and the cathode. The light emitting element OLED functions as a light emitting capacitor Coled, which emits light in a period that a positive bias is applied, and accumulates charges in a period that a negative bias is applied.

Figure 5:
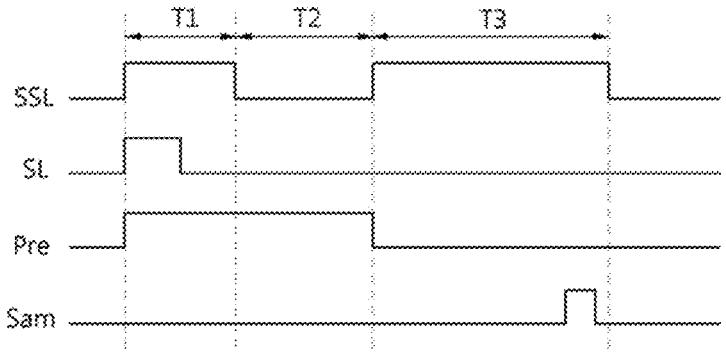
FIG. 5 is a waveform diagram illustrating a first embodiment of drive signals supplied to the pixel driving circuit illustrated in FIG. 4.

FIG. 5 illustrates a method for driving each pixel driving circuit of the above-described organic light emitting device in accordance with a first embodiment of the present invention. As illustrated in FIG. 5, the driving method is executed in the order of an initialization period T1, a light emission period T2, and a sensing period T3. Hereinafter, the initialization period T1 illustrated in FIG. 5 will be described in detail with reference to FIG. 6A. The light emission period T2 illustrated in FIG. 5 will be described in detail with reference to FIG. 6B. The sensing period T3 illustrated in FIG. 5 will be described in detail with reference to FIGS. 6C and 6D.

Figure 6A:
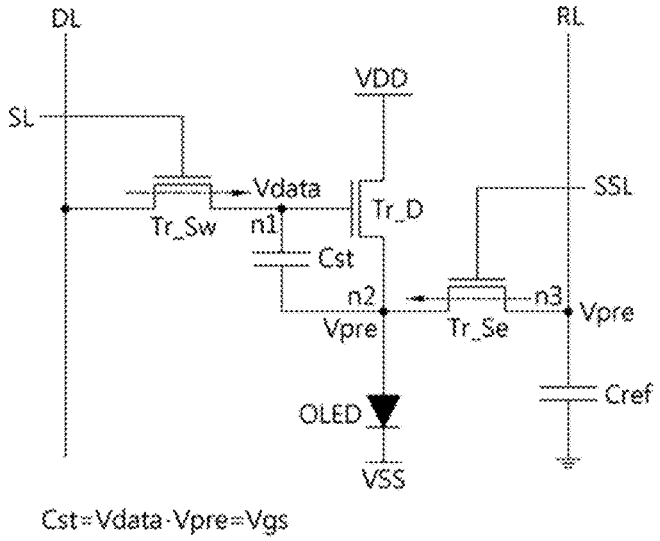
FIGS. 6A to 6D are diagrams explaining a method for driving the pixel driving circuit illustrated in FIG. 4 in accordance with a first embodiment of the present invention.

As illustrated in FIGS. 5 and 6A, in the initialization period T1, a first scan voltage having a high level is supplied to the scan line SL, and a second scan voltage having a high level is supplied to the sensing control line SSL. In addition, a precharging control voltage Pre having a high level is supplied to the gate of the precharging transistor Tr_Pre, a sampling control voltage Sam having a low level is supplied to the gate of the sampling transistor Tr_Sam, and a data voltage Vdata is supplied to the data line DL. In this case, the data voltage Vdata has a predetermined voltage level for sensing of a threshold voltage of the driving transistor Tr_D.

Accordingly, in response to the high-level first scan voltage, the switching transistor Tr_Sw turns on. The sensing transistor Tr_Se turns on in response to the high-level second scan voltage. The precharging transistor Tr_Pre turns on in response to the high-level precharging control voltage Pre. In response to the low-level sampling control voltage Sam, the sampling transistor Tr_Sam turns off.

The data voltage Vdata from the data line DL is supplied to the first node n1, namely, the gate of the driving transistor Tr_D, via the turned-on switching transistor Tr_S1. The precharging voltage Vpre is supplied to the reference line RL via the turned-on precharging transistor Tr_Pre. The precharging voltage Vpre from the reference line RL is supplied to the second node n2, namely, the source of the driving transistor Tr_D, via the turned-on sensing transistor Tr_Se. As a result, during the initialization period T1, the source of the driving transistor Tr_D and the reference line RL are initialized with the precharging voltage Vpre. In this case, a voltage difference between the data voltage Vdata and the precharging voltage Vpre is stored in the storage capacitor Cst.

Figure 6B:
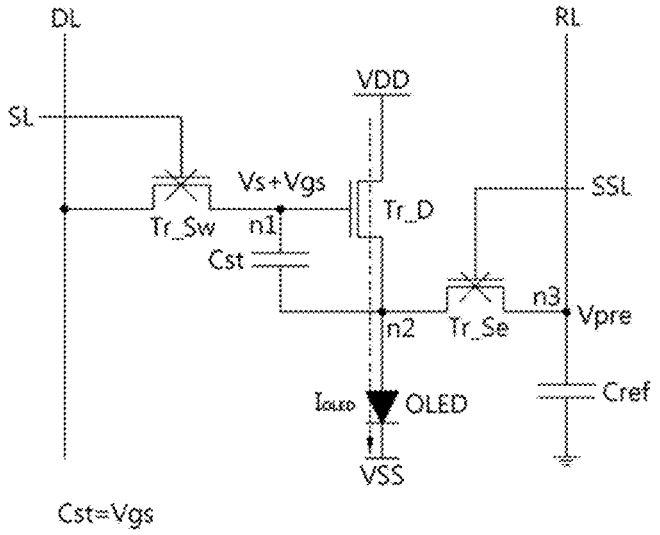

Thereafter, as illustrated in FIGS. 5 and 6B, in the light emission period T2, a first scan voltage having a low level is supplied to the scan line SL, a second scan voltage having a low level is supplied to the sensing control line SSL, and a sampling control voltage Sam having a low level is supplied to the gate of the sampling transistor Tr_Sam. In addition, the precharging control voltage Pre, which is supplied to the precharging transistor Tr_Pre, is maintained at a high level.

Accordingly, in response to the low-level first scan voltage, the switching transistor Tr_Sw turns off. The sensing transistor Tr_Se turns off in response to the low-level second scan voltage. In response to the low-level sampling control voltage Sam, the sampling transistor Tr_Sam turns off. The precharging transistor Tr_Pre turns on in response to the high-level precharging control voltage Pre.

In this case, although the switching transistor Tr_Sw turns off, the voltage stored in the storage capacitor Cst is supplied to the driving transistor Tr_D as the drive voltage Vgs. Accordingly, the driving transistor Tr_D is turned on by the voltage stored in the storage capacitor Cst, namely, a voltage Vdata-Vpre. The turned-on driving transistor Tr_D supplies, to the light emitting element OLED, a drive current determined in accordance with a voltage difference between the data voltage Vdata and the precharging voltage Vpre, which is stored in the storage capacitor Cst and, as such, the light emitting element OLED emits light in proportion to a drive current $I_{OLED}$ flowing from the high-level voltage source VDD to the low-level voltage source VSS.

Figure 6C:
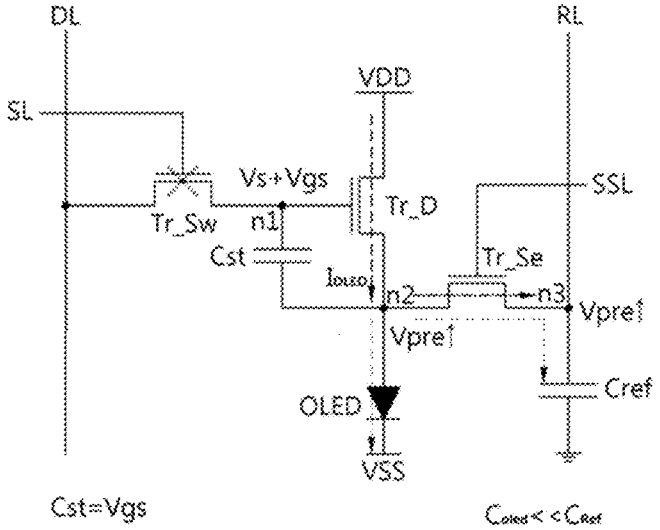

Thereafter, as illustrated in FIGS. 5 and 6C, in a first half of the sensing period T3, the first scan voltage supplied to the switching transistor Tr_Sw via the scan line SL is maintained at a low level, and the sampling control voltage Sam supplied to the gate of the sampling transistor Tr_Sam is maintained at a low level. In addition, a second scan voltage having a high level is supplied to the sensing control line SSL, and a precharging control voltage Pre having a low level is supplied to the gate of the precharging transistor Tr_Pre.

Accordingly, in response to the low-level first scan voltage, the switching transistor Tr_Sw turns off. The precharging transistor Tr_Pre turns off in response to the low-level precharging control voltage Pre. The sampling transistor Tr_Sam turns off in response to the low-level sampling control voltage Sam. The sensing transistor Tr_Se turns on in response to the high-level second scan voltage.

Figure 7:
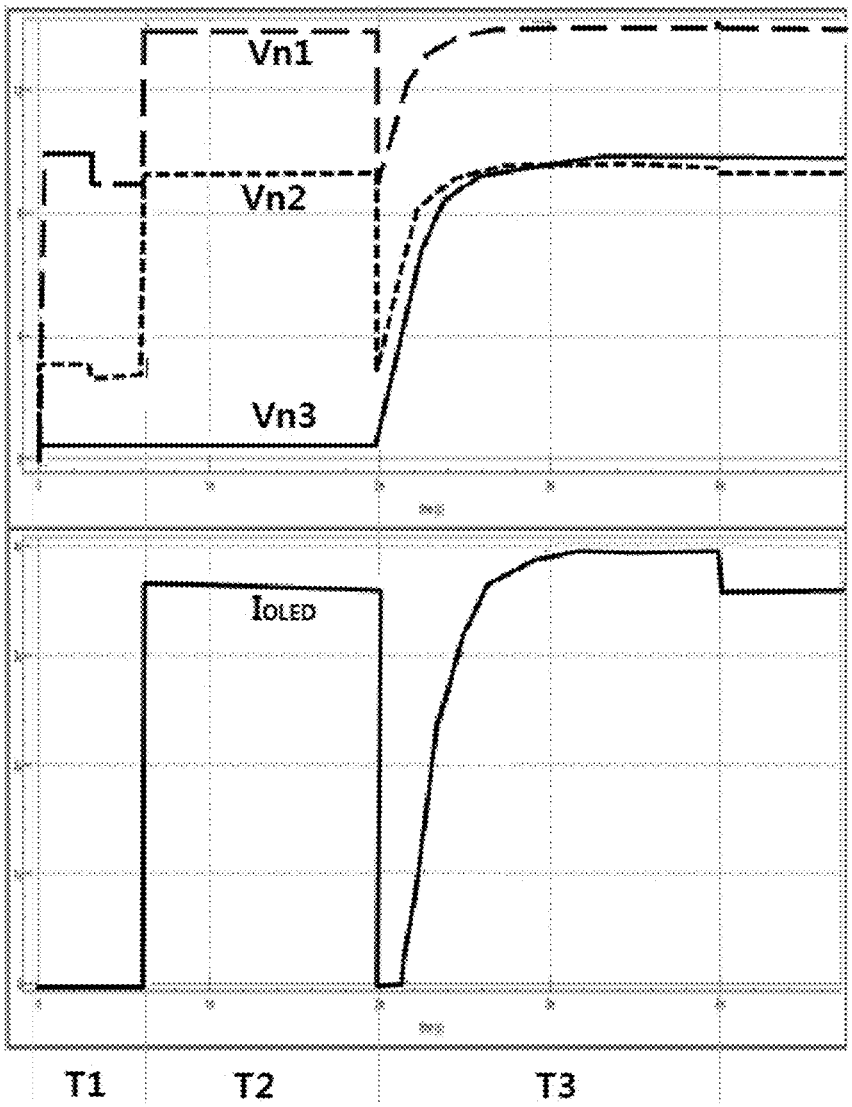
FIG. 7 is a waveform diagram explaining a voltage of each node and a drive current in the pixel driving circuit, which is driven using the drive signals illustrated in FIG. 5.

The second node n2 and third node n3 are connected via the turned-on sensing transistor Tr_Se and, as such, the voltage of the third node n3, namely, a voltage Vn3, rises to the voltage of the second node n2, namely, a voltage Vn2. Accordingly, the capacitor Cref of the reference line RL charges the second node voltage Vn2, namely, an anode voltage. As a result, as illustrated in FIG. 7, the voltage on the reference line RL, namely, the third node voltage Vn3, which has fallen, rises at a time when the sensing transistor Tr_Se turns on and, as such, the drive current $I_{OLED}$ supplied to the light emitting element OLED also rises.

Figure 6D:
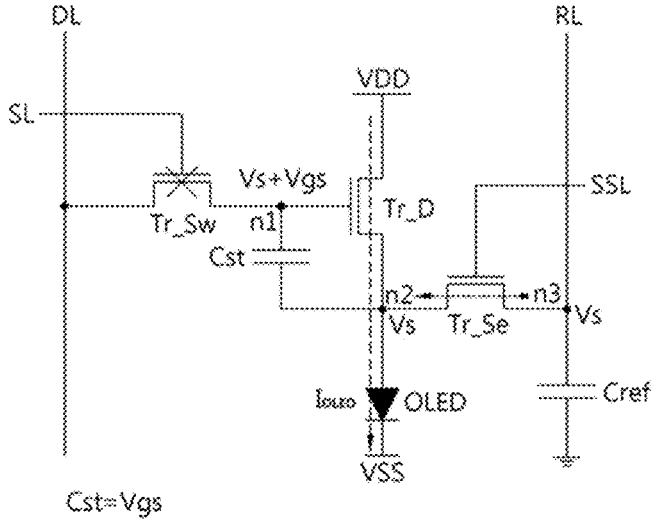

Subsequently, as illustrated in FIGS. 5 and 6D, in a second half of the sensing period T3, the first scan voltage supplied to the switching transistor Tr_Sw via the scan line SL is maintained at a low level, and the second scan voltage supplied to the sensing transistor Tr_Se via the sensing control line SSL is maintained at a high level. In addition, the precharging control voltage Pre supplied to the gate of the precharging transistor Tr_Pre is maintained at a low level. A sampling control voltage Sam having a high level is supplied to the gate of the sampling transistor Tr_Sam.

In response to the high-level sampling control voltage Sam, the sampling transistor Tr_Sam turns on and, as such, the reference line RL is connected to the sensing unit 114. Accordingly, the sensing unit 114 senses a voltage of the second node n2 connected to the reference line RL via the turned-on sensing transistor Tr_Se, namely, an anode voltage Vs of the light emitting element OLED during light emission of the light emitting element OLED, and, as such, may calculate a driving point of the light emitting element OLED.

Thus, the sensing unit 114 senses the voltage of the reference line RL, namely, the voltage Vs supplied to the anode of the light emitting element OLED during light emission of the light emitting element OLED, generates digital sensing data SData based on the sensed voltage Vs, and supplies the sensing data SData to the timing controller 108. The timing controller 108 calculates a deviation of the driving point of the light emitting element OLED, based on the sensing data SData from the sensing unit 114, and stores the calculated driving point data in the memory thereof. Using the driving point data stored in the memory, the timing controller 108 generates compensated data for the light emitting element OLED, and outputs the compensated data to the data driver 104.

Thus, the organic light emitting display device operating in accordance with the first embodiment of the present invention may sense a driving point of the light emitting element through sensing of the anode voltage of the light emitting element. Accordingly, the organic light emitting display device according to the present invention may generate compensated data according to driving point shift of the light emitting element and, as such, may enhance lifespan and luminance.

Figure 8:
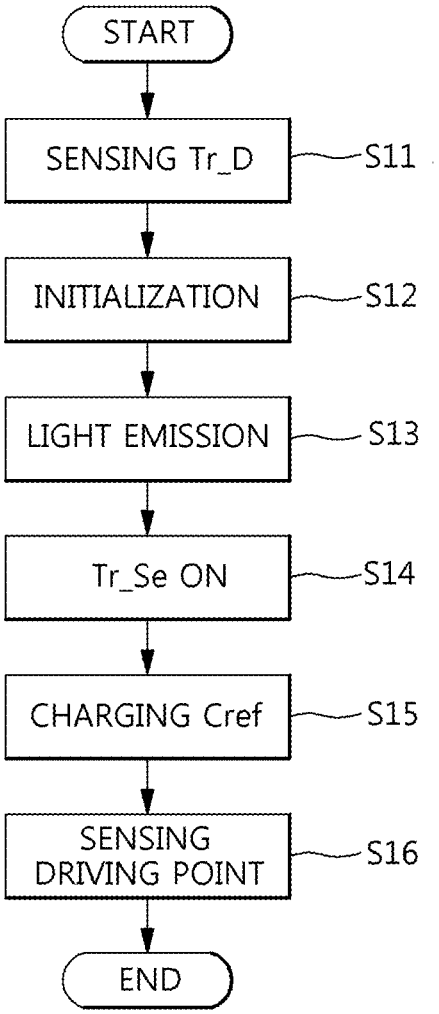
FIG. 8 is a flowchart explaining a method for driving the pixel driving circuit illustrated in FIG. 4 in accordance with the first embodiment of the present invention.

FIG. 8 is a flowchart explaining an external compensation method according to the first embodiment of the present invention.

First, sensing data is generated through sensing of a threshold voltage or mobility of the driving transistor Tr_D in each pixel. A data voltage compensated based on the sensing data is then generated (S11). Using the compensated data voltage for the driving transistor Tr_D, an anode voltage of the light emitting element OLED is sensed.

In detail, as illustrated in FIGS. 5 and 6A, the compensated data voltage is supplied to the data line DL, and a precharging voltage Vpre is supplied to the reference line RL and, as such, the source of the driving transistor Tr_D and reference line RL are initialized by the precharging voltage Vpre (S12). Thereafter, as illustrated in FIGS. 5 and 6B, a drive current determined based on a voltage difference between the data voltage Vdata stored in the storage capacitor Cst and the precharging voltage Vpre is supplied to the light emitting element OLED and, as such, the light emitting element OLED emits light in proportion to a drive current $I_{OLED}$ flowing from the high-level voltage source VDD to the low-level voltage source VSS (S13).

Thereafter, as illustrated in FIGS. 5 and 6C, the sensing transistor Tr_Se turns on (S14) and, as such, the anode of the light emitting element OLED and reference line RL are connected. Accordingly, the capacitor Cref of the reference line RL charges the second node voltage Vn2, namely, the anode voltage (S15). Subsequently, as illustrated in FIGS. 5 and 6D, the sensing unit 114 senses a voltage of the second node n2 connected to the reference line RL via the turned-on sensing transistor Tr_Se, namely, an anode voltage Vs of the light emitting element OLED during light emission of the light emitting element OLED, and, as such, may calculate a driving point of the light emitting element OLED.

Figure 9:
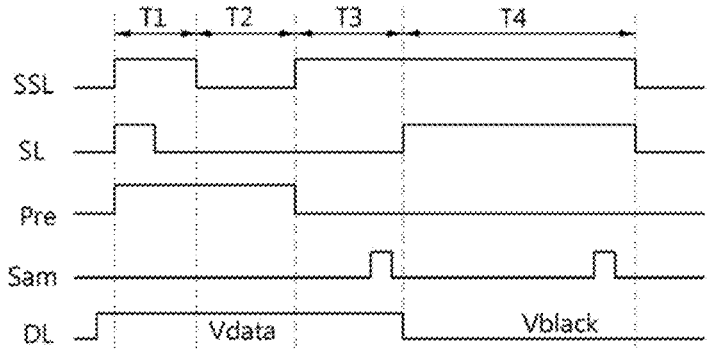
FIG. 9 is a waveform diagram illustrating a second embodiment of drive signals supplied to the pixel driving circuit illustrated in FIG. 4.

FIG. 9 is a waveform diagram illustrating a method for driving each pixel driving circuit of the above-described organic light emitting device in accordance with a second embodiment of the present invention.

Figure 10A:
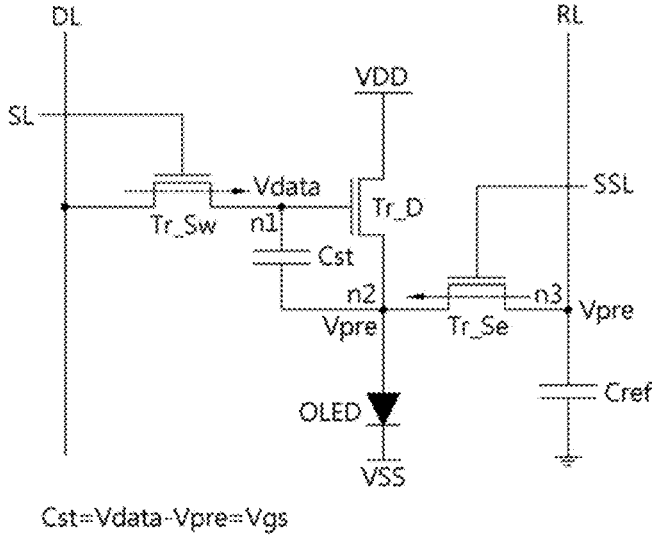
FIGS. 10A to 10F are diagrams explaining a method for driving the pixel driving circuit illustrated in FIG. 4 in accordance with a second embodiment of the present invention.
Figure 10B:
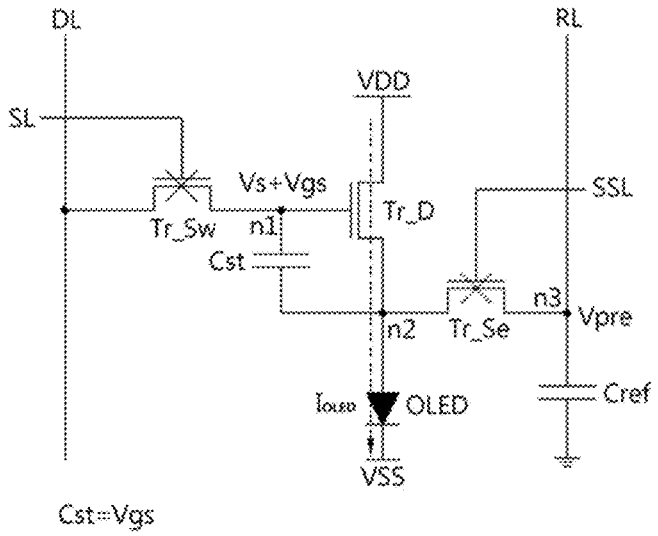
Figure 10C:
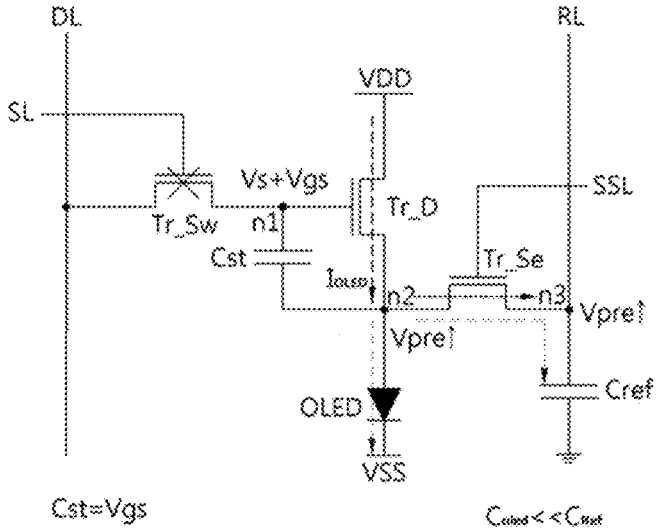
Figure 10D:
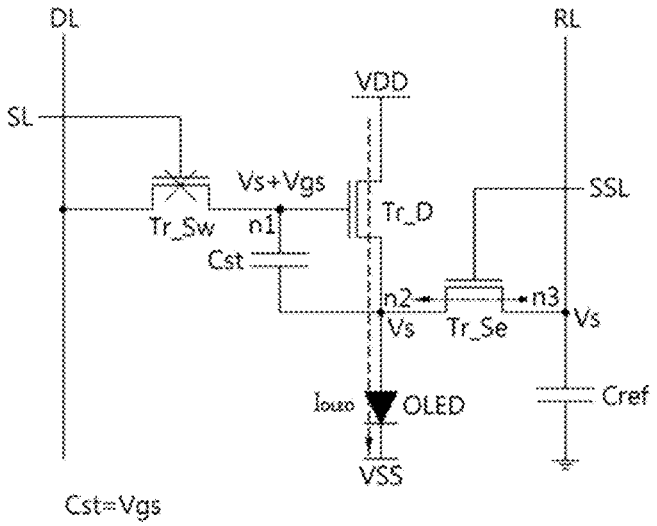

As illustrated in FIG. 9, the driving method is executed in the order of an initialization period T1, a light emission period T2, a first sensing period T3, and a second sensing period T4. Hereinafter, the initialization period T1 illustrated in FIG. 9 will be described in detail with reference to FIG. 10A. The light emission period T2 illustrated in FIG. 9 will be described in detail with reference to FIG. 10B. The first sensing period T3 illustrated in FIG. 9 will be described in detail with reference to FIGS. 10C and 10D. The second sensing period T4 illustrated in FIG. 9 will be described in detail with reference to FIGS. 10E and 10F.

The initialization period T1, light emission period T2 and first sensing period T3 illustrated in FIGS. 10A to 10D are the same as the initialization period T1, light emission period T2 and first sensing period T3 illustrated in FIGS. 5A to 5D and, as such, no detailed description thereof will be given.

Figure 10E:
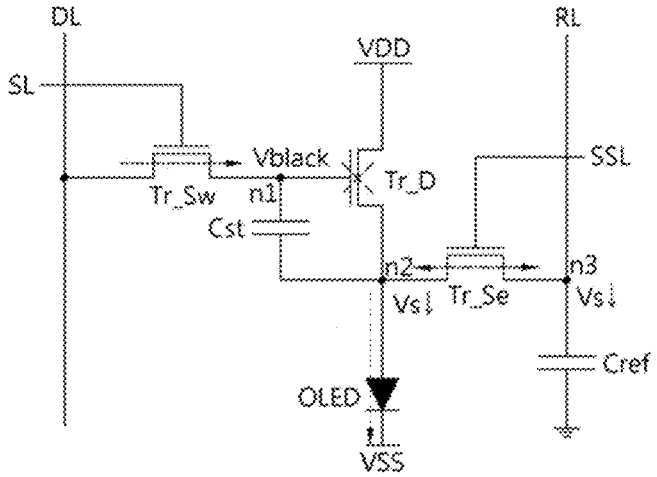

As illustrated in FIGS. 9 and 10E, in a first half of the second sensing period T4, a first scan voltage having a high level is supplied to the scan line SL, and a sampling control voltage Sam having a low level is supplied to the gate of the sampling transistor Tr_Sam. In addition, the precharging control voltage Pre supplied to the gate of the precharging transistor Tr_Pre is maintained at a low level, and the second scan voltage supplied to the sensing control line SSL is maintained at a high level. A black data voltage Vblack, for example, a data voltage of 0V, is supplied to the data line.

Accordingly, the precharging transistor Tr_Pre turns off in response to the low-level precharging control voltage Pre. In response to the low-level sampling control voltage Sam, the sampling transistor Tr_Sam turns off. The switching transistor Tr_Sw turns on in response to the high-level first scan voltage. In response to the high-level second scan voltage, the sensing transistor Tr_Se turns on.

The black data voltage Vblack from the data line DL is supplied to the first node n1, namely, the gate of the driving transistor Tr_D, via the turned-on switching transistor Tr_Sw and, as such, the driving transistor Tr_D turns off. As the driving transistor Tr_D turns off, the voltage Vn2 of the second node N2 falls.

Figure 11:
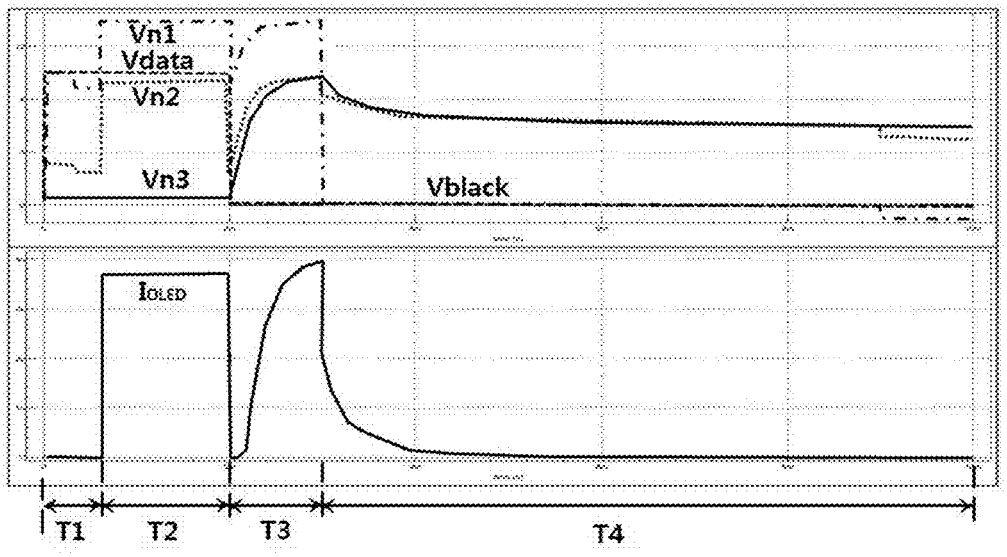
FIG. 11 is a waveform diagram explaining a voltage of each node and a drive current in the pixel driving circuit, which is driven using the drive signals illustrated in FIG. 9.

Meanwhile, the second node n2 and third node n3 are connected via the turned-on sensing transistor Tr_Se and, as such, the voltage Vn3 of the third node n3 falls to the voltage Vn2 of the second node n2. Accordingly, the voltage charged in the capacitor Cref of the reference line RL is discharged to the low-level voltage source VSS until the voltage has the same level as the threshold voltage Vth_OLED of the light emitting element OLED. That is, as illustrated in FIG. 11, the voltage on the reference line RL, namely, the third node voltage Vn3, falls at a time when the driving transistor Tr_D turns off. As a result, the drive current $I_{OLED}$ supplied to the light emitting element OLED also falls. When the voltage charged in the capacitor Cref falls to the threshold voltage Vth_OLED of the light emitting element OLED, the light emitting element OLED no longer emits light.

Figure 10F:
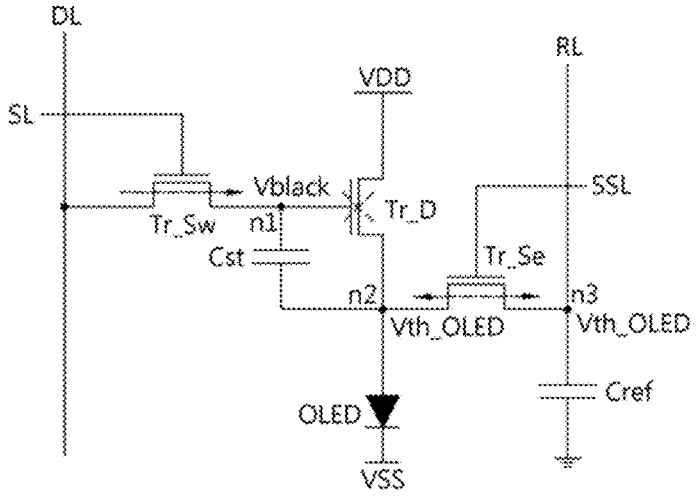

Subsequently, as illustrated in FIGS. 9 and 10F, in a second half of the second sensing period T4, the first scan voltage supplied to the switching transistor Tr_Sw via the scan line SL is maintained at a high level, and the second scan voltage supplied to the sensing transistor Tr_Se via the sensing control line SSL is maintained at a high level. In addition, the precharging control voltage Pre supplied to the gate of the precharging transistor Tr_Pre is maintained at a low level. A sampling control voltage Sam having a high level is supplied to the gate of the sampling transistor Tr_Sam.

In response to the high-level sampling control voltage Sam, the sampling transistor Tr_Sam turns on and, as such, the reference line RL is connected to the sensing unit 114.

Accordingly, the sensing unit 114 senses a voltage of the second node n2 connected to the reference line RL via the turned-on sensing transistor Tr_Se, namely, an anode voltage Vs of the light emitting element OLED during non-emission of the light emitting element OLED, and, as such, may calculate a threshold voltage Vth_OLED of the light emitting element OLED.

Thus, the sensing unit 114 senses the voltage of the reference line RL, namely, the threshold voltage Vth_OLED of the light emitting element OLED during non-emission of the light emitting element OLED, generates digital sensing data SData based on the sensed threshold voltage Vth_OLED, and supplies the sensing data SData to the timing controller 108. The timing controller 108 calculates a deviation of the threshold voltage of the light emitting element OLED, based on the sensing data SData from the sensing unit 114, and stores the calculated data in the memory thereof. Using the data stored in the memory, the timing controller 108 generates compensated data R'G'B', and outputs the compensated data to the data driver 104.

Thus, the organic light emitting display device operating in accordance with the second embodiment of the present invention may sense a driving point of the light emitting element and a threshold voltage of the light emitting element through sensing of the anode voltage of the light emitting element. Accordingly, the organic light emitting display device according to the present invention may generate compensated data according to driving point shift and threshold voltage variation of the light emitting element and, as such, may achieve an increase in lifespan and an enhancement in luminance.

Figure 12:
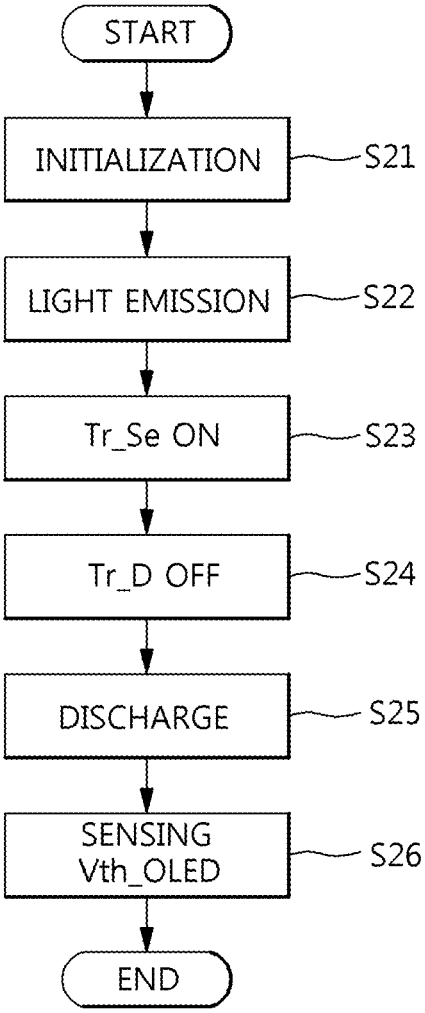
FIG. 12 is a flowchart explaining a method for driving the pixel driving circuit illustrated in FIG. 4 in accordance with the second embodiment of the present invention.

FIG. 12 is a flowchart explaining an external compensation method according to the first embodiment of the present invention.

First, sensing data is generated through sensing of a threshold voltage or mobility of the driving transistor Tr_D in each pixel. A data voltage compensated based on the sensing data is then generated. Using the compensated data voltage for the driving transistor Tr_D, an anode voltage of the light emitting element OLED is sensed.

In detail, as illustrated in FIG. 9 and FIGS. 10A to 10D, the source of the driving transistor Tr_D and reference line RL are initialized by the precharging voltage Vpre (S21). Thereafter, the light emitting element OLED emits light (S22), and the sensing transistor Tr_Se turns on (S23). Accordingly, an anode voltage Vs of the light emitting element OLED during light emission of the light emitting element OLED is sensed and, as such, a driving point of the light emitting element OLED is calculated.

Thereafter, as illustrated in FIGS. 9 and 10E, the black data voltage Vblack is applied to the gate of the driving transistor Tr_D, as such, the driving transistor Tr_D turns off (S24). Then, the voltage stored in the capacitor Cref connected to the reference line RL is discharged to the light emitting element OLED (S25). Subsequently, as illustrated in FIGS. 9 and 10F, an anode voltage of the light emitting element OLED during non-emission of the light emitting element OLED is sensed and, as such, a threshold voltage of the light emitting element OLED is calculated (S26).

Meanwhile, the organic light emitting device according to the embodiments of the present invention may compensate for deviations in characteristics caused by degradation of the light emitting element, not only in a test process executed before shipment of the product, but also after shipment of the product, through sensing of an anode voltage during a display period, in which the organic light emitting device is driven, or during a measurement period between display periods.

As apparent from the above description, in accordance with various examples of the organic light emitting device of the present invention, it may be possible to sense a driving point of the light emitting element and a threshold voltage of the light emitting element through sensing of an anode voltage of the light emitting element. Accordingly, it may be possible to generate compensated data according to driving point shift and threshold voltage variation of the light emitting element and, as such, an increase in lifespan and an enhancement in luminance may be achieved.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. An organic light emitting display device, comprising:

a light emitting display panel comprising a plurality of pixels, each pixel including a light emitting element and a pixel driving circuit to drive the light emitting element; and a panel driving unit for supplying compensated data voltages to the plurality of pixels, respectively, wherein the panel driving unit senses, through sensing of an anode voltage of the light emitting element in each of the plurality of pixels, a driving point of the light emitting element in a light emission period of the light emitting element, and generates compensated data according to a driving point shift of the light emitting element using the sensed driving point of the light emitting element.

2. The organic light emitting display device according to claim 1, wherein the panel driving unit comprises:

a scan driver for supplying a scan signal to scan lines respectively connected to the plurality of pixels, and supplying a sensing signal to sensing control lines;

a data driver for driving data lines respectively connected to the plurality of pixels, and sensing the anode voltage of the light emitting element in each of the plurality of pixels during the light emission period of the light emitting element; and a timing controller for generating compensated data for the light emitting element, using the sensed anode voltage.

3. The organic light emitting display device according to claim 2, wherein the pixel driving circuit comprises:

a driving transistor connected to the light emitting element in series between a high-level voltage source and a low-level voltage source;

a switching transistor for connecting a corresponding one of the data lines and a first node connected to a gate of the driving transistor in response to a first scan signal supplied to a corresponding one of the scan lines;

a sensing transistor for connecting a second node connected to a source of the driving transistor and a reference line in response to a second scan signal supplied to a corresponding one of the sensing control lines; and a storage capacitor connected between the first node and the second node.

4. The organic light emitting display device according to claim 3, wherein:

the pixel driving circuit is driven in an order of an initialization period, the light emission period, and a sensing period;

in the initialization period, the switching transistor and the sensing transistor turn on, to initialize the first node by a data voltage supplied via the corresponding data line and to initialize the second node by a precharging voltage supplied via the reference line;

in the light emission period, the driving transistor turns on, to control a drive current supplied to the light emitting element; and in the sensing period, the sensing transistor turns on, to store the anode voltage in the storage capacitor connected to the reference line, and senses the anode voltage of the light emitting element during light emission of the light emitting element, to sense the driving point of the light emitting element.

5. The organic light emitting display device according to claim 4, wherein characteristics of the drive current are sensed before the initialization period, to generate a compensated data voltage for the driving transistor.

6. An organic light emitting display device comprising:

a display panel including a plurality of pixels, each pixel including a light emitting element and a pixel driving circuit to drive the light emitting element; and a panel driving unit including a data driver and a timing controller, and wherein the panel driving unit is configured to sense a driving point of the light emitting element in a light emission period of the light emitting element, and to sense a threshold voltage of the light emitting element in a non-emission period of the light emitting element, by sensing an anode voltage of the light emitting element, wherein the driving point of the light emitting element is sensed during the light emission period of the light emitting element, wherein the threshold voltage of the light emitting element is sensed during the non-emission period of the light emitting element when a black data voltage is supplied to a gate of a driving transistor of the pixel driving circuit to turn off the driving transistor and the anode voltage stored in a capacitor connected to a reference voltage line is discharged, and wherein the timing controller generates compensated data for the light emitting element using the sensed anode voltages and outputs compensated data voltages to the data driver to drive the plurality of pixels.

7. The organic light emitting display device according to claim 6, wherein the panel driving unit further includes:

a scan driver for supplying a scan signal to scan lines respectively connected to the plurality of pixels, and supplying a sensing signal to sensing control lines; and the data driver for driving data lines respectively connected to the plurality of pixels, and sensing the anode voltage of the light emitting element in each of the pixels during the light emission and non-emission periods of the light emitting element.

8. The organic light emitting display device according to claim 7, wherein the pixel driving circuit further includes:

the driving transistor connected to the light emitting element in series between a high-level voltage source and a low-level voltage source;

a switching transistor for connecting a corresponding one of the data lines and a first node connected to a gate of the driving transistor in response to a first scan signal supplied to a corresponding one of the scan lines;

a sensing transistor for connecting a second node connected to a source of the driving transistor and a reference line in response to a second scan signal supplied to a corresponding one of the sensing control lines; and a storage capacitor connected between the first node and the second node.

9. The organic light emitting display device according to claim 8, wherein:

the pixel driving circuit is driven in an order of an initialization period, the light emission period, and a first sensing period and a second sensing period;

in the initialization period, the switching transistor and the sensing transistor turn on to initialize the first node by a data voltage supplied via the corresponding data line and to initialize the second node by a pre-charging voltage supplied via the reference line;

in the light emission period, the driving transistor turns on to control a drive current supplied to the light emitting element;

in the first sensing period, the sensing transistor turns on to store the anode voltage in the storage capacitor connected to the reference line, and senses the anode voltage of the light emitting element during light emission of the light emitting element to sense the driving point of the light emitting element; and in the second sensing period, a black data voltage is supplied to the gate of the driving transistor, to turn off the driving transistor, and a voltage stored in the capacitor connected to the reference line via the turned-on sensing transistor is discharged, to sense a threshold voltage of the light emitting element in the non-emission period of the light emitting element.

10. The organic light emitting display device according to claim 9, wherein characteristics including the drive current are sensed before the initialization period to generate compensated data for the driving transistor.

* * * * *